US005390902A

United States Patent [19]

Szadkowski

[11] Patent Number: 5,390,902

[45] Date of Patent: Feb. 21, 1995

[54] BELT FOR SEALING A POURING TUBE

[75] Inventor: Stanislav Szadkowski, Marly, Switzerland

[73] Assignee: International Industrial Engineering S.A., Braine-L'Alleud, Belgium

[21] Appl. No.: 142,288

[22] PCT Filed: May 7, 1992

[86] PCT No.: PCT/BE92/00016

§ 371 Date: Nov. 19, 1993

§ 102(e) Date: Nov. 19, 1993

[87] PCT Pub. No.: WO/9220480

PCT Pub. Date: Nov. 26, 1992

[30] Foreign Application Priority Data

May 21, 1991 [BE] Belgium ..... 9100475

[51] Int. Cl.[6] ..... B22D 41/42

[52] U.S. Cl. ..... 266/217; 266/236; 222/600; 222/603

[58] Field of Search ..... 266/236, 217; 222/603, 222/600, 591, 590

[56] References Cited

U.S. PATENT DOCUMENTS

| | | | |
|---|---|---|---|
| 3,887,117 | 6/1975 | Fehling | 222/603 |
| 4,365,731 | 12/1982 | Fehling et al. | 222/600 |
| 5,004,131 | 4/1991 | Russo | 222/600 |

FOREIGN PATENT DOCUMENTS

| | | | |
|---|---|---|---|
| 0048641 | 3/1982 | European Pat. Off. . | |
| 0495999 | 7/1992 | European Pat. Off. . | |
| 2227073 | 11/1974 | France . | |
| 0891379 | 6/1982 | France . | |
| 2551374 | 8/1985 | France . | |
| 2179573 | 3/1987 | United Kingdom | 222/603 |

*Primary Examiner*—Scott Kastler

*Attorney, Agent, or Firm*—Sughrue, Mion, Zinn, Macpeak & Seas

[57] ABSTRACT

A belt for sealing a discharge device of a ferrous-metallurgical vessel is formed by two concentric grooves formed in one and/or the other of a pair of superimposed sliding plates. A first, outer, groove (8) is connected to a vacuum source and a second, inner, groove (1) is connected to an inert-gas source.

7 Claims, 3 Drawing Sheets

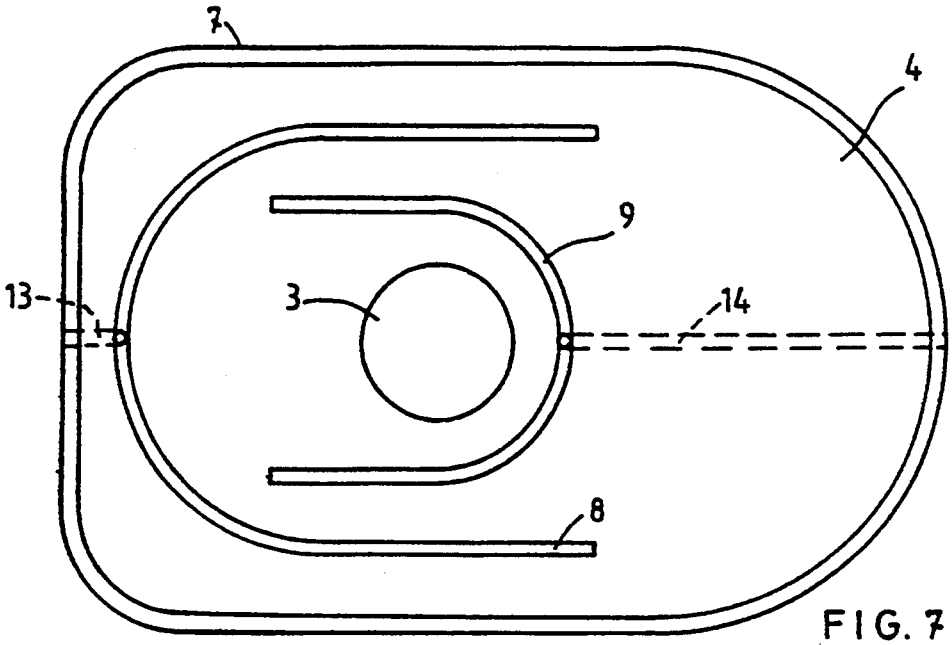
FIG. 7
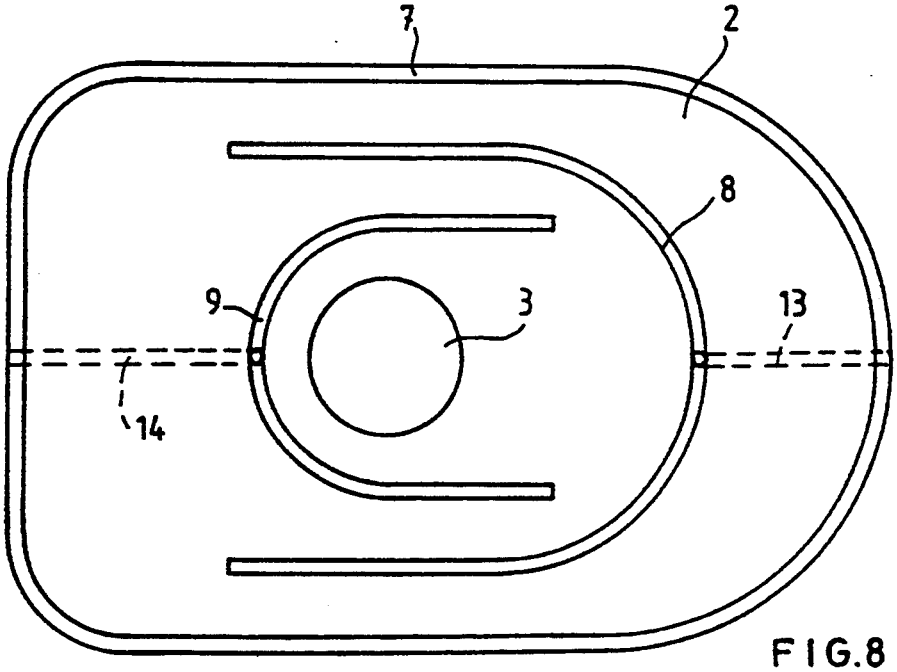
FIG.8
FIG. 9
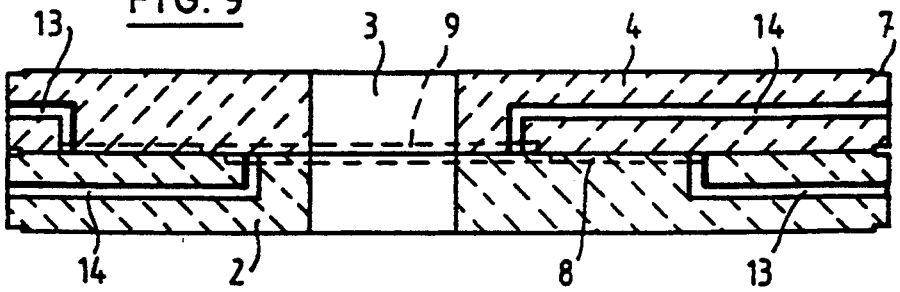

BELT FOR SEALING A POURING TUBE

BACKGROUND OF THE INVENTION

The subject of the present invention is a belt for sealing the discharge device of a bottom-pouring ferrous-metallurgical vessel and/or the device for bringing into position and for exchanging a pouring tube, comprising a top or reference plate applied from below and a fixed bottom plate carrying the pouring tube.

The invention finds wide application in the manufacture of refractory elements of a device for changing a pouring tube or of a closing-off device having sliding plates for a metallurgical vessel from which the steel is discharged into a mold or an ingot mold.

It is known that the tap hole of a closing-off device having plates which can slide or are simply superimposed is at a reduced pressure compared to the ambient atmosphere. This reduced pressure causes an intake of ambient air, especially in the region of the joint between the refractory plates and through possible cracks in said plates. This air intake turns out to be highly detrimental both to the quality of the metal poured and to the behavior of the elements made of refractory material. Oxygen, nitrogen and moisture contained in the air taken into the runner react chemically by oxidation, nitriding and/or hydriding to the detriment of the liquid metal as well as to the detriment of the elements made of refractory material.

Air mechanically entrained during pouring causes metal to rise back up or exogenous blowholes to be formed. Furthermore, the oxidized metal tends to stick in the pouring tube and to give an oxide film which, in the case of an ingot mold, can initiate skin defects.

Various attempts have been made to prevent air infiltration into the tap hole through the junction zone between the reference plate (top plate) and the plate which carries the pouring tube (bottom plate). They are based on the idea of creating, around the unsealed parts of the tap hole, an artificial atmosphere consisting of an inert gas, such as argon for example, so that the gas taken in does not cause a detrimental effect.

Document FR-A-2,227,073 describes a closing-off device having sliding plates, in which device the lower face of the reference plate which forms the sliding surface, has a single groove extending in the form of a U around the tap hole. The groove is connected to an inert-gas source. The ends of the branches of the U are separated by a distance greater than the diameter of the tap hole. This groove makes it possible to develop, in the pores of the refractory materials which surround the tap hole, a gas pressure which opposes the ferrostatic pressure and prevents the steel from wetting the refractory materials.

Finally, a method is known, from Belgian Patent No. 891,379, for rendering airtight a device for closing off the orifice for bottom discharge of a metallurgical vessel comprising a reference plate made of refractory material. A substantially circular groove, forming a sealed lock around the tap hole, is formed in the lower face of the reference plate. The groove is isolated by an inner annular sealing zone and an outer annular sealing zone, these zones being concentric, formed in at least one of the contact faces of the two plates which are perfectly applied one against the other. It is connected to an inert-gas source.

The main drawback of the single groove resides in the fact that the resulting safety is insufficient. The preventive measure constitutes only a single precaution. Furthermore, it allows no control or detection of a possible anomaly.

SUMMARY OF THE INVENTION

The object of the present invention is to overcome these drawbacks by providing a sealing belt intended to render airtight the closure of a bottom-pouring ferrous-metallurgical vessel or of a device for bringing into position and for exchanging a pouring tube comprising at least one reference plate and one movable or fixed plate applied from below against the bottom of the vessel.

In accordance with the invention, the sealing belt provided around the pouring tube consists of two concentric grooves formed in one or the other of the abovementioned plates and centered on the axis of the tap hole, so as to delimit three separate zones, namely a first, inner, annular zone surrounding the tap hole, a second, intermediate, annular zone delimited by the two grooves and a third, outer, zone lying between the outer groove and the periphery of the plate, the outer groove being connected to a vacuum source and the inner groove to an inert-gas source.

Five possibilities exist for producing a double sealing belt between the top plate and the pouring tube carrying the bottom plate:

1. formation of a pair of grooves concentric with the tap hole in the lower face of the top plates
2. formation of a pair of grooves concentric with the tap hole in the upper face of the bottom plate of the pouring tube;
3. formation of pairs of concentric grooves both in the upper face of the bottom plate and the lower face of the top plate;
4. formation of an inner groove in the lower face of the top plate and an outer groove concentric with the first in the upper face of the bottom plate, and
5. formation of an outer groove in the lower face of the top plate and an inner groove concentric with the first in the upper face of the bottom plate.

The creation of a vacuum in the outer groove has a two-fold advantage. It makes it possible to prevent any infiltration of air into the chamber between the two grooves and protects all the better the tap hole generally subjected to a reduced pressure by the Venturi effect. It therefore ensures the absence of air in the pouring stream and thus prevents the metal from rising back up and blowholes from forming.

The absence of air also allows the introduction into an alloy of a precise quantity of oxidizable elements without appreciable loss and with high reproducibility. This naturally results in a very much greater uniformity in the quality of the metal.

The second advantage of the creation of a vacuum in the outer groove resides in the possibility of detecting the sealing of the sliding closure easily with the aid of a pressure-measuring probe.

The measuring probe must, of course, be installed close to the outer groove in the intake channel.

According to a particular feature of the invention, the sealing belt is formed in a reference plate. The refractory plate in which the sealing belt is formed can also be a fixed plate carrying the tube.

In a particular embodiment, the refractory plate contains channels connecting the two abovementioned grooves, the outer groove to a vacuum source and the inner groove to an inert-gas source.

According to one design of the invention, the outer groove of the refractory plate is connected to a vacuum-creating apparatus and to a vacuum-measuring apparatus.

These particular features and details of the invention will appear during the description of the appended drawings which represent diagrammatically, and by way of non-limiting illustration, three embodiments of the device for rendering airtight the discharge device of a pouring distributor according to the invention, namely two devices for bringing into position and for exchanging a pouring tube and a device for regulating a bottom-pouring ferrous-metallurgical vessel.

BRIEF DESCRIPTION OF THE DRAWINGS

In these drawings:

FIG. 7 is a view from below of the lower face of a top plate of a device for regulating a ferrous-metallurgical vessels FIG. 8 is a view, in plan, seen from above, of the upper face of a lower plate of the regulating devices; and FIG. 9 is a view in vertical section of the regulating device constituted by the superposition of the plates shown in FIGS. 7 and 8.

DESCRIPTION OF PREFERRED EMBODIMENTS

In these various figures, the same reference notations designate identical elements.

Figure 1:
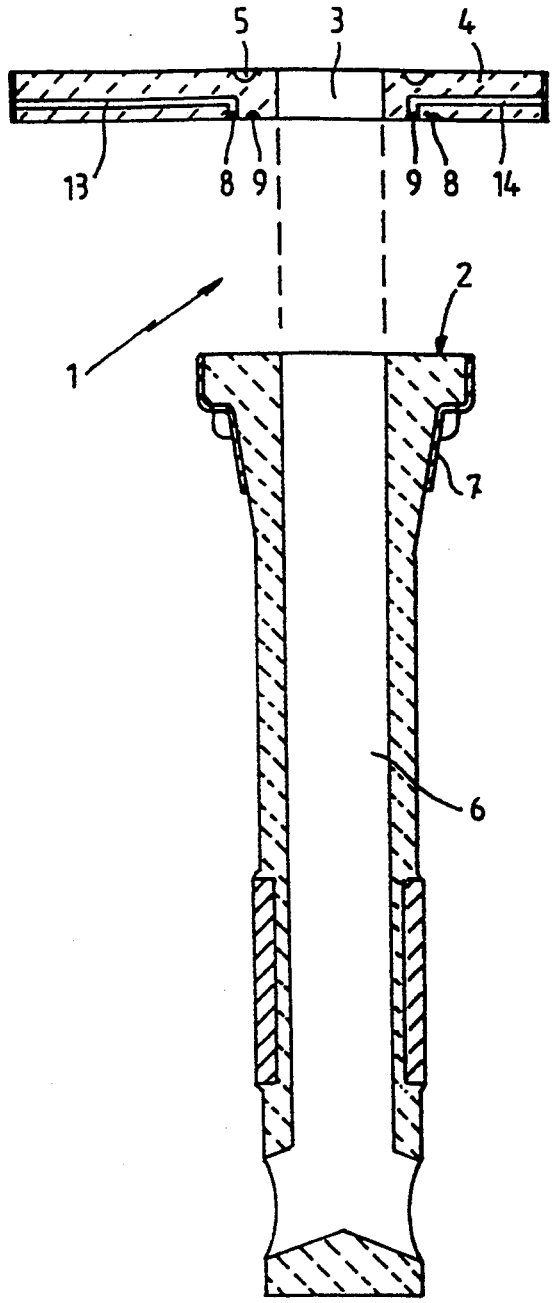
FIG. 1 is a vertical section of a bottom-pouring device comprising a reference plate having a lower face in which is provided a sealing belt according to the invention and a strictly planar bottom plate firmly attached to a pouring tube.

As illustrated in FIG. 1, a regulating device having sliding plates or a device for bringing into position and exchanging a pouring tube, which device is designated in its entirety by the reference notation 1, consists of a bottom plate 2 firmly attached to a pouring tube made of refractory material having a tap hole 3 of defined diameter and fitted with a top plate 4 intended to be applied by means of a groove 5 against a lip of an internal nozzle, not shown. The bottom plate 2 carries a pouring tube 6.

The bottom plate 2 is reinforced by a steel sleeve 7. It is pushed back up by means of springs or of cylinders, not shown, which apply it against the reference or top plate 4. The bottom plate 2 carrying the pouring tube 6 is capable of sliding along the top plate 4 under the action of a displacement mechanism (preferably designed in the form of a pneumatic cylinder, not shown) during the operation for bringing into position and for exchanging a pouring tube.

Figure 3:
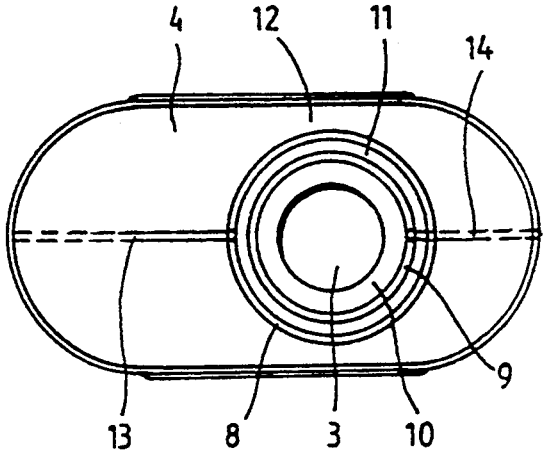
FIG. 3 shows, in plan, a view from below of the lower face of the reference plate shown in FIG. 1.
Figure 2:
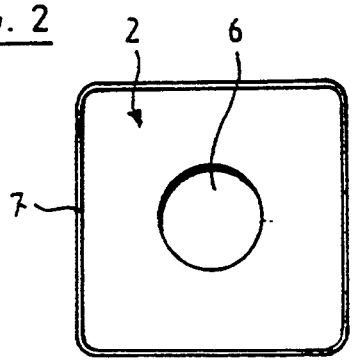
FIG. 2 shows, in plan, a view from above of the refractory bottom plate firmly attached to the pouring tube.

In order to prevent the infiltration of air into the pouring stream, a sealing belt, consisting of two concentric annular grooves 8, 9 centered on the axis of the tap hole 3, is provided in the lower face of the top plate 4, between the outer edge of the bottom plate and the tap hole, so as to delimit three separate concentric annular zones (see FIG. 3).

A first annular zone 10, called the inner zone, surrounds the tap hole. A second annular zone 11, called the intermediate zone, lies between the two grooves 8 and 9. A third zone 12, called the outer zone, is delimited by the peripheral edge 13 of the top plate 4 and the outer edge of the outer groove 8. The grooves 8 and 9 form locks isolated from each other and from the outside by the annular sealing zones 10, 11, 12 formed by the contacting surface portions of the plates perfectly applied one against the other.

If, for any reason, lack of sealing should arise between the reference plate 4 and the bottom plate 2, the vacuum created in the outer groove 8 would be destroyed and the outside air would be in contact with the inert gas of the inner groove 9, which would increase the risk of air being taken into the pouring tube 6 on account of the reduced pressure prevailing therein.

A means for measuring the vacuum in the outer groove 8 makes it possible to indicate directly any abnormal loss of vacuum before any risk of air intake into the pouring tube.

The outer groove 8 is connected to a vacuum source, constituted for example by a trompe, not shown, or by a vacuum pump, via a radial channel 13 provided in the top plate (see FIG. 1). This radial channel is also connected up to an apparatus for measuring the pressure, making it possible to monitor the vacuum prevailing in the outer groove 8 and possibly to emit a signal in the event of lack of sealing in the plate-contacting joint.

The inner groove 9 is connected to an inert-gas source via a radial channel 14 formed in the top plate. The pressure of the inert gas in the inner groove 9 is maintained slightly above atmospheric pressure by injection of inert gas.

In the event of loss of inert gas on account of any lack of sealing, any possible reduction in the pressure prevailing in the inner groove 9 is corrected by letting in fresh inert gas. This is regulated, for example, by an automatic valve coupled to a measuring apparatus enabling the pressure in the abovementioned inner groove 9 to be determined.

Significant losses of inert gas are, on the other hand, indicated by a warning system so as to allow operators to take suitable measures.

Argon is advantageously used as the inert gas. Unlike nitrogen, which causes some nitriding of the steel, argon protects the molten metal from any oxidation without causing a secondary effect capable of impairing the quality of the metal.

When the lower face of the top plate and the upper face of the tube are applied perfectly one against the other, the contacting surface portions of the plates constitute annular sealing zones 10, 11 and 12 on either side of each groove 8,9.

Because it is arranged in the lower face of the top plate, the double groove 8, 9 according to the invention is not subject to accidental blockage. It does not run the risk of being contaminated by residues of molten metal when the tube 6 is slid in order to replace it by a new one since the flow of metal is interrupted with the aid of a stopper rod during this operation. The sealing device according to the invention is easy to keep in good condition, by virtue of the fact that any residue of metal is eliminated under the effect of gravity during possible removal of the bottom plate 2.

FIG. 3 shows a view from above of the upper face of the bottom plate 2 shown in FIG. 1.

In a second embodiment of a belt for sealing between two plates, provision is made to form the pair of grooves in the upper face-of the bottom plate 2 of the pouring tube (FIG. 5) instead of having it in the top plate 4 shown in FIG. 3.

Figure 4:
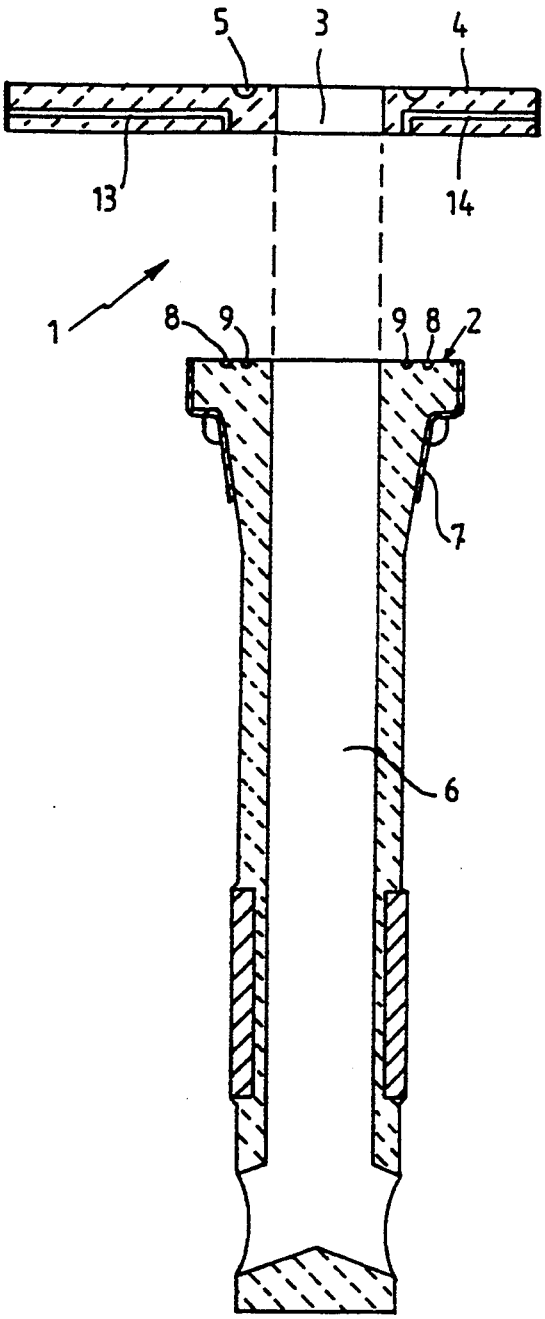
FIG. 4 is a vertical section, similar to that shown in FIG. 1, of a pouring device comprising a reference plate and a bottom plate of a pouring tube having an upper face in which a sealing belt according to the invention is provided.
Figure 6:
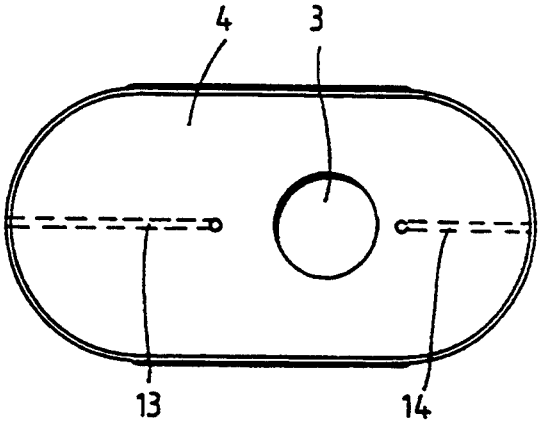
FIG. 6 is a view, in plan, seen from below, of the lower face of the refractory top plate shown in FIG. 4.
Figure 5:
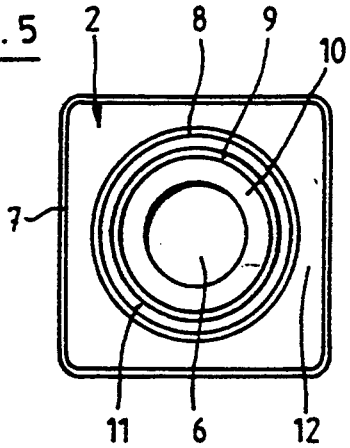
FIG. 5 is a view, in plan, seen from above, of the upper face of the bottom plate firmly attached to the pouring tube shown in FIG. 4.

FIG. 4 shows, in vertical section, similar to FIG. 1, but with the sealing belt shown in FIG. 5, that is to say provided in the upper surface of the bottom plate 2 of the pouring tube.

The inert-gas intake 13 and injection 14 channels of the bottom plate 2 of the pouring tube are always drilled in the top plate 4, as FIGS. 1, 3, 4 and 6 show.

The grooves 8 and 9 can easily be produced with the aid of a grinding wheel by removal of material. The channels 13 and 14 which connect the grooves 8 and 9 to the inert-gas or vacuum sources (not shown) can be produced by drilling as shown in FIGS. 1, 3, 4 and 6 or be provided during the manufacture of the refractory plates.

A groove 5 for sealing the internal nozzle is provided in the upper face of the top plate 4 (FIGS. 1 and 4) in order to be applied in a sealed manner against a lip, not shown, of an internal nozzle.

It is obvious that the invention is not exclusively limited to the embodiments shown and that many modifications may be made in the arrangement and the construction of some of the elements involved in the embodiments described, on condition that these modifications do not contradict the subject of each of the following claims.

Thus, as illustrated in FIGS. 7 to 9, the invention also applies to a regulating device having sliding plates, in which device the lower face of the reference plate 4, which forms the sliding surface, has two rectangular oblong, or U-shaped, grooves 8, 9 one fitted into the other so as to be substantially equidistant at every point (FIG. 1, 3). The choice of the shape and of the length of the double groove 8, 9 is made depending on the amplitude of the movement of the movable plate 2, this amplitude being limited to a maximum value by the length of the overlap zone surrounded by the groove via which the inert gas is injected, and to a minimum value by the internal diameter of the tap hole 3 of the movable plate 2.

I claim:

1. A belt for sealing a discharge device of a bottom-pouring ferrous-metallurgical vessel, comprising a top or reference plate applied from below against the bottom of the vessel and a bottom plate, which is fixed or movable, carrying a pouring tube, wherein said sealing belt consists of two concentric grooves formed in one or the other of the abovementioned plates and centered on the axis of the tap hole, so as to delimit three separate zones, namely a first, inner, annular zone surrounding the tap hole, a second, intermediate, annular zone delimited by the two grooves and a third, outer, zone lying between the outer groove and the periphery of the plate, and wherein the outer groove is connected to a vacuum source and the inner groove to an inert-gas source.

2. The sealing belt as claimed in claim 1, wherein said sealing belt is formed in a reference plate.

3. The sealing belt as claimed in claim 1, wherein said sealing belt is formed in a bottom plate carrying a tube.

4. The sealing belt as claimed in claims 1, 2, or 3, wherein the outer groove connected up to a vacuum source is also connected to means for measuring the vacuum.

5. The sealing belt as claimed in claim 4, wherein the means for measuring the vacuum are fitted with sound-generating or light-generating warning means indicating a loss of vacuum.

6. A refractory plate provided with a sealing belt as claimed in claim 1, wherein said refractory plate contains inert-gas intake and injection channels connecting the abovementioned grooves to the vacuum source or the inert-gas source.

7. The refractory plate provided with a sealing belt as claimed in claim 6, wherein the inert-gas intake and injection channels of the bottom plate of the pouring tube are extended by radial intake channels drilled in the top plate.

* * * * *